US009506346B2

(12) United States Patent
Bright et al.

(10) Patent No.: US 9,506,346 B2
(45) **Date of Patent: *Nov. 29, 2016**

(54) OVERFLOW VORTEX TRANSFER SYSTEM

(75) Inventors: Mark A. Bright, Sewickley, PA (US); Jason Tetkoskie, Cleveland Heights, OH (US); Richard S. Henderson, Solon, OH (US); Herbert L. Ritchie, Jr., Macedonia, OH (US); Jorge A. Morando, Solon, OH (US)

(73) Assignee: PYROTEK, INC., Spokane, WA (US)

( * ) Notice: Subject to any disclaimer, the term of this patent is extended or adjusted under 35 U.S.C. 154(b) by 751 days.

This patent is subject to a terminal disclaimer.

(21) Appl. No.: 13/378,078

(22) PCT Filed: Jun. 15, 2010
(Under 37 CFR 1.47)

(86) PCT No.: PCT/US2010/038597

§ 371 (c)(1),
(2), (4) Date: Jun. 29, 2012

(87) PCT Pub. No.: WO2010/147932

PCT Pub. Date: Dec. 23, 2010

(65) Prior Publication Data

US 2013/0101424 A1 Apr. 25, 2013

Related U.S. Application Data

(60) Provisional application No. 61/187,457, filed on Jun. 16, 2009.

(51) Int. Cl.

| | |
|---|---|
| ***F01D 5/12*** | (2006.01) |
| ***F04D 1/14*** | (2006.01) |
| ***F04D 7/06*** | (2006.01) |

(52) U.S. Cl.
CPC . *F01D 5/12* (2013.01); *F04D 1/14* (2013.01); *F04D 7/065* (2013.01)

(58) Field of Classification Search
USPC ..... 415/182.1, 200, 206, 88, 216.1, 217.1
See application file for complete search history.

(56) References Cited

U.S. PATENT DOCUMENTS

| | | | |
|---|---|---|---|
| 3,612,715 | A | 10/1971 | Yedidiah |
| 3,836,280 | A | 9/1974 | Koch |

(Continued)

OTHER PUBLICATIONS

Photographs submitted as an Attachment to "Response to Jun. 29, 2012 filing of Petition Under 37 CFR §1.47(a)", submitted in U.S. Appl. No. 13/378,078.

(Continued)

*Primary Examiner* — Igor Kershteyn
*Assistant Examiner* — Justin Seabe
(74) *Attorney, Agent, or Firm* — Fay Sharpe LLP

(57) ABSTRACT

The present invention is directed to a molten metal pump comprising an elongated pumping chamber tube with a base end and an open top end. A shaft extends into the tube and rotates an impeller therein, the impeller rotates proximate the base end. The tube has a diameter at least 1.1 times the diameter of the impeller. The pumping chamber tube preferably has a length at least three times the height of the impeller. The base end includes an inlet and the top end includes a tangential outlet. Rotation of the impeller draws molten metal into the pumping chamber and creates a rotating equilibrium vortex that rises up the walls of the pumping chamber. The rotating vortex adjacent the top end exists the device cia the tangential outlet.

20 Claims, 12 Drawing Sheets

(56) References Cited

U.S. PATENT DOCUMENTS

| | | | | |
|---|---|---|---|---|
| 4,128,415 | A | 12/1978 | Van Linden et al. | |
| 4,286,985 | A | 9/1981 | Van Linden et al. | |
| 5,268,020 | A * | 12/1993 | Claxton | 75/708 |
| 5,411,240 | A | 5/1995 | Rapp et al. | |
| 5,441,390 | A | 8/1995 | Rapp et al. | |
| 2001/0048186 | A1 | 12/2001 | Boulet | |
| 2004/0191138 | A1 | 9/2004 | Wagner | |
| 2008/0314548 | A1 | 12/2008 | Cooper | |
| 2010/0104415 | A1 | 4/2010 | Morando | |

OTHER PUBLICATIONS

Paragraph 1.8 of Jorge A. Morando Statement Accompanying "Response to Jun. 29, 2012 filing of Petition Under 37 CFR §1.47(a)", submitted in U.S. Appl. No. 13/378,078.

* cited by examiner

OVERFLOW VORTEX TRANSFER SYSTEM

BACKGROUND

Pumps for pumping molten metal are used in furnaces in the production of metal articles. Common functions of pumps are circulation of molten metal in the furnace or transfer of molten metal to remote locations along transfer conduits or risers that extend from a base of the pump to the remote location.

Currently, many metal die casting facilities employ a main hearth containing the majority of the molten metal. Solid bars of metal may be periodically melted in the main hearth. A transfer pump is located in a separate well adjacent the main hearth. The transfer pump draws molten metal from the well in which it resides and transfers it into a ladle or conduit and from there to die casters that form the metal articles. The present invention relates to pumps used to transfer molten metal from a furnace to a die casting machine, ingot mould, DC caster or the like.

A traditional molten metal transfer pump is described in U.S. Pat. No. 6,286,163, the disclosure of which is herein incorporated by reference. Referring to FIG. 1, the molten metal pump is indicated generally by the reference numeral 10. The pump 10 is adapted to be immersed in molten metal contained within a vessel 12. The vessel 12 can be any container containing molten metal, although the vessel 12 as illustrated is an external well of a reverberatory furnace 13. The pump 10 has a base member 14 within which an impeller (not shown) is disposed. The impeller includes an opening along its bottom or top surface that defines a fluid inlet for the pump 10. The impeller is supported for rotation within the base member 14 by means of an elongate, rotatable shaft 18. The upper end of the shaft 18 is connected to a motor 20. The base member 14 includes an outlet passageway connected to a riser 24. A flanged pipe 26 is connected to the upper end of the riser 24 for discharging molten metal into a spout or other conduit (not shown). The pump 10 thus described is so-called transfer pump, that is, it transfers molten metal from the vessel 12 to a location outside of the vessel 12.

Another exemplary transfer pump is described in CA 2284985. The pump consists of two main parts, an upper tube portion which is suspended above the molten magnesium bath during operation and lower tube portion which is immersed in the bath. A motor is positioned at the top of the upper portion. A coupling attaches an auger shaft to the motor. The coupling holds the weight of the auger shaft and positions it in place inside the tube. The auger shaft is centered within the internal diameter of the two portions, running the length of both, and is held in position by a set of guide bearings. The lower portion is comprised of a cylindrical casing in which the auger is located and aligned. Several inlet holes are located in the walls of the cylindrical casing. A second set of inlet holes in the cylindrical casing are located near the base of the pump. These inlet holes permit the surrounding molten metal to enter the pump.

The auger comprises a shaft, upon which are welded flutes. The pitch of the flutes preferably varies between 2 to 4 inches. The auger acts like a positive displacement pump. The rotation of the auger shaft by the motor supplies a steady force to the molten magnesium, forcing the molten liquid to the bottom of the pump and out of an elbow shaped connector located at the outlet end of the cylindrical casing at the base of the pump. The molten magnesium displaced to the bottom of the pump is downwardly forced out through the connector by means of the rotation of the auger. The connector is attached to a heated transfer tube which will convey the molten magnesium from the holding furnace to the die of a casting machine.

A further alternative transfer pump is described in U.S. Published Application 2008/0314548. The system comprises at least (1) a vessel for retaining molten metal, (2) a dividing wall (or overflow wall) within the vessel, the dividing wall having a height H1 and dividing the vessel into a least a first chamber and a second chamber, and (3) a molten metal pump in the vessel, preferably in the first chamber. The second chamber has a wall or opening with a height H2 that is lower than height H1 and the second chamber is juxtaposed another structure, such as a ladle or lauder, into which it is desired to transfer molten metal from the vessel. The pump (either a transfer, circulation or gas-release pump) is submerged in the first chamber (preferably) and pumps molten metal from the first chamber past the dividing wall and into the second chamber causing the level of molten metal in the second chamber to rise. When the level of molten metal in the second chamber exceeds height H2, molten metal flows out of the second chamber and into another structure. If a circulation pump, which is most preferred, or a gas-release pump were utilized, the molten metal would be pumped through the pump discharge and through an opening in the dividing wall wherein the opening is preferably completely below the surface of the molten metal in the first chamber.

BRIEF DESCRIPTION

Various details of the present disclosure are hereinafter summarized to provide a basic understanding. This summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter.

According to one embodiment of this disclosure, a molten metal pump comprising an elongated tube having a base end and a top end is provided. A shaft extends into the tube and rotates an impeller proximate the base end. The tube has a diameter at least 1.1 times the diameter of the impeller. The tube has a length at least three times the height of the impeller. The base end includes an inlet and the top end includes an outlet.

According to an alternative embodiment, a molten metal pump comprised of an elongated refractory body is provided. The refractory body includes an inlet region having an inlet region diameter, a vortex region having a vortex region diameter, and an outlet region having an outlet region diameter. The outlet region diameter is greater than the vortex region diameter which is greater than the inlet region diameter. An impeller is disposed in or adjacent the inlet. A shaft extends through the vortex region and the outlet region and includes a first end engaging the impeller and a second end adapted to engage a motor.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detail description of the disclosure when considered in conjunction with the drawings, in which.

DETAILED DESCRIPTION OF THE PREFERRED EMBODIMENTS

Figure 1:
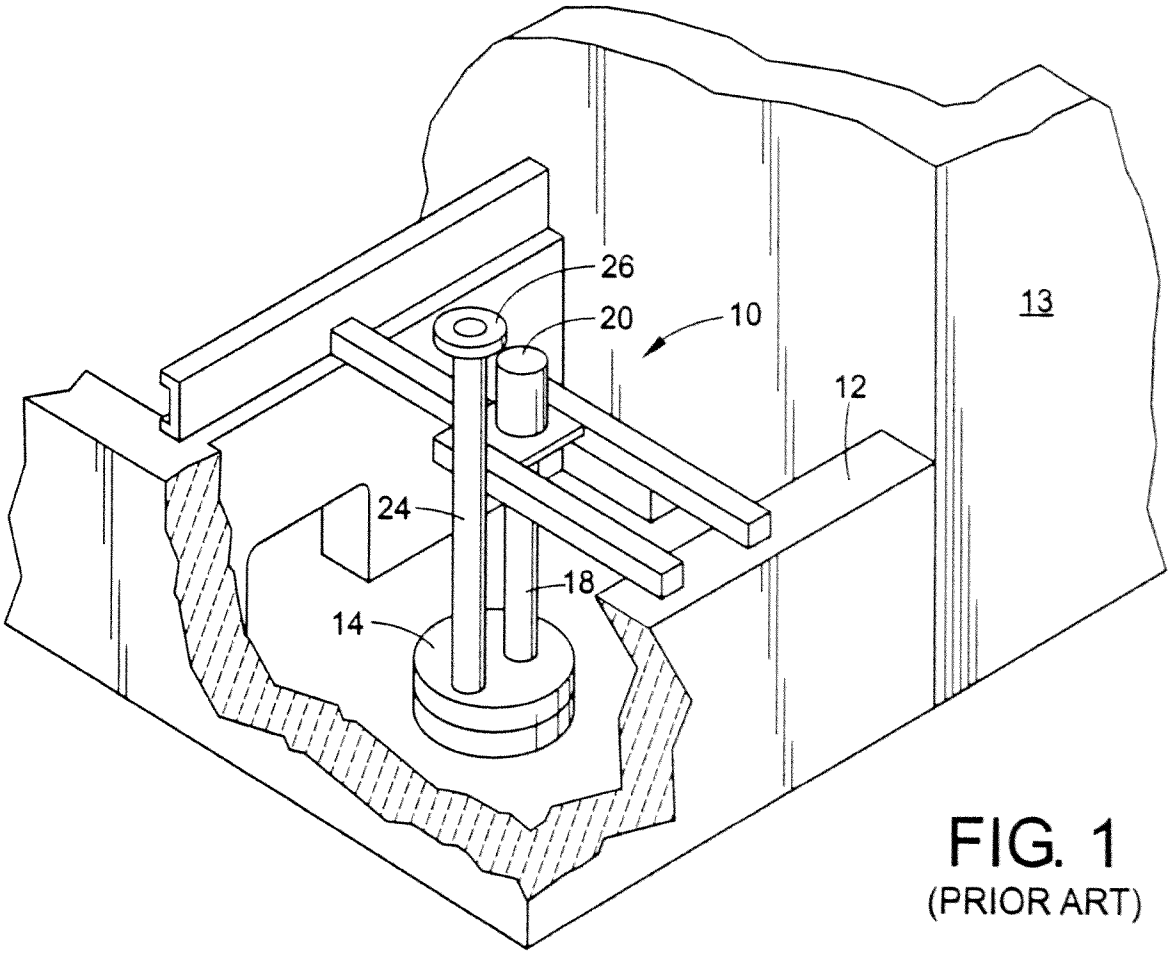
FIG. 1 (PRIOR ART)
FIG. 1 is a schematic view of a prior art system including a furnace, a melting bay and an adjacent bay containing a transfer pump.

One or more embodiments or implementations are hereinafter described in conjunction with the drawings, where like reference numerals are used to refer like elements throughout, and where the various features are not necessary drawn to scale.

Figure 2:
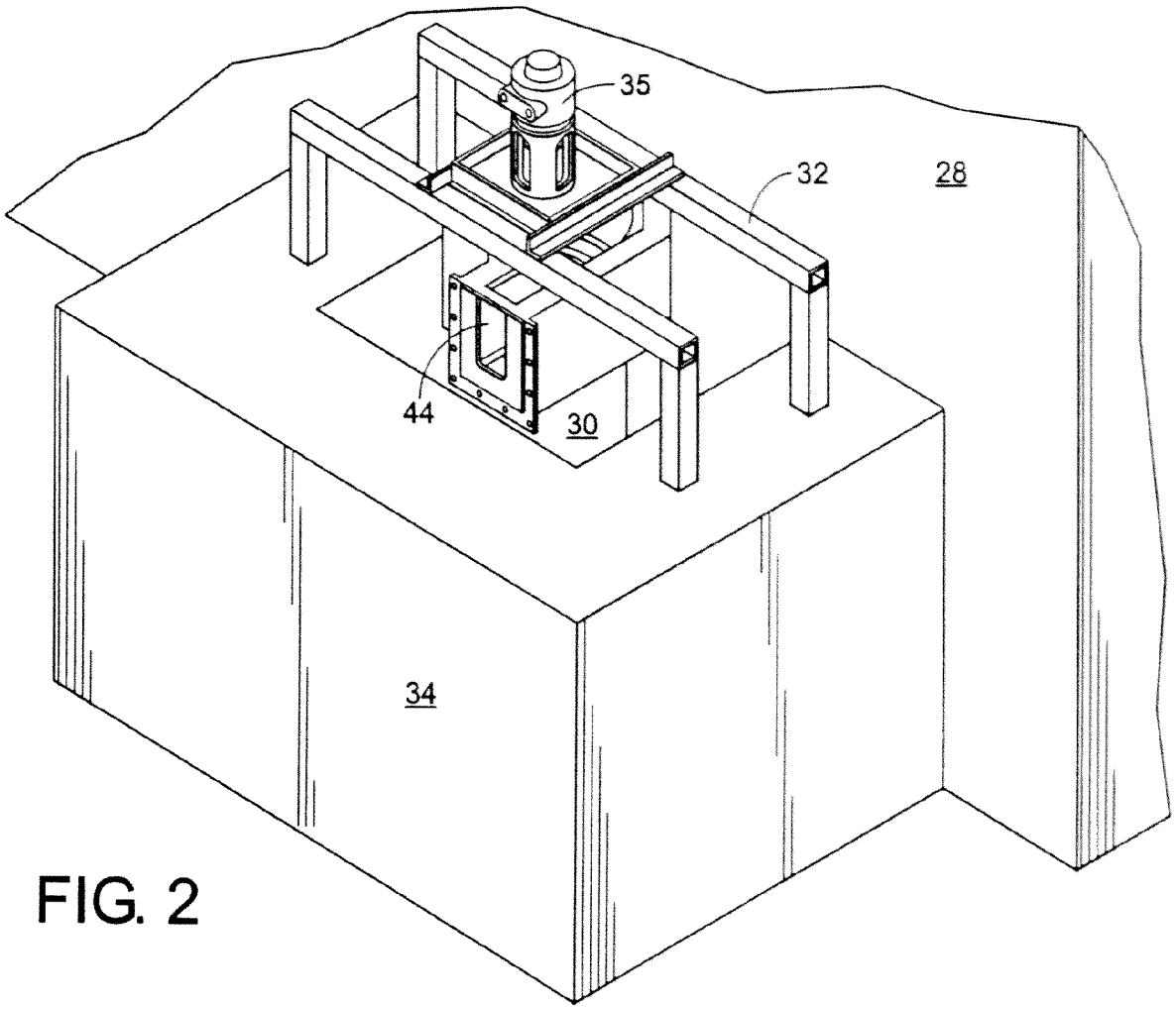
FIG. 2 is a perspective view showing a molten metal transfer system including the pump disposed in a furnace bay.
Figure 3:
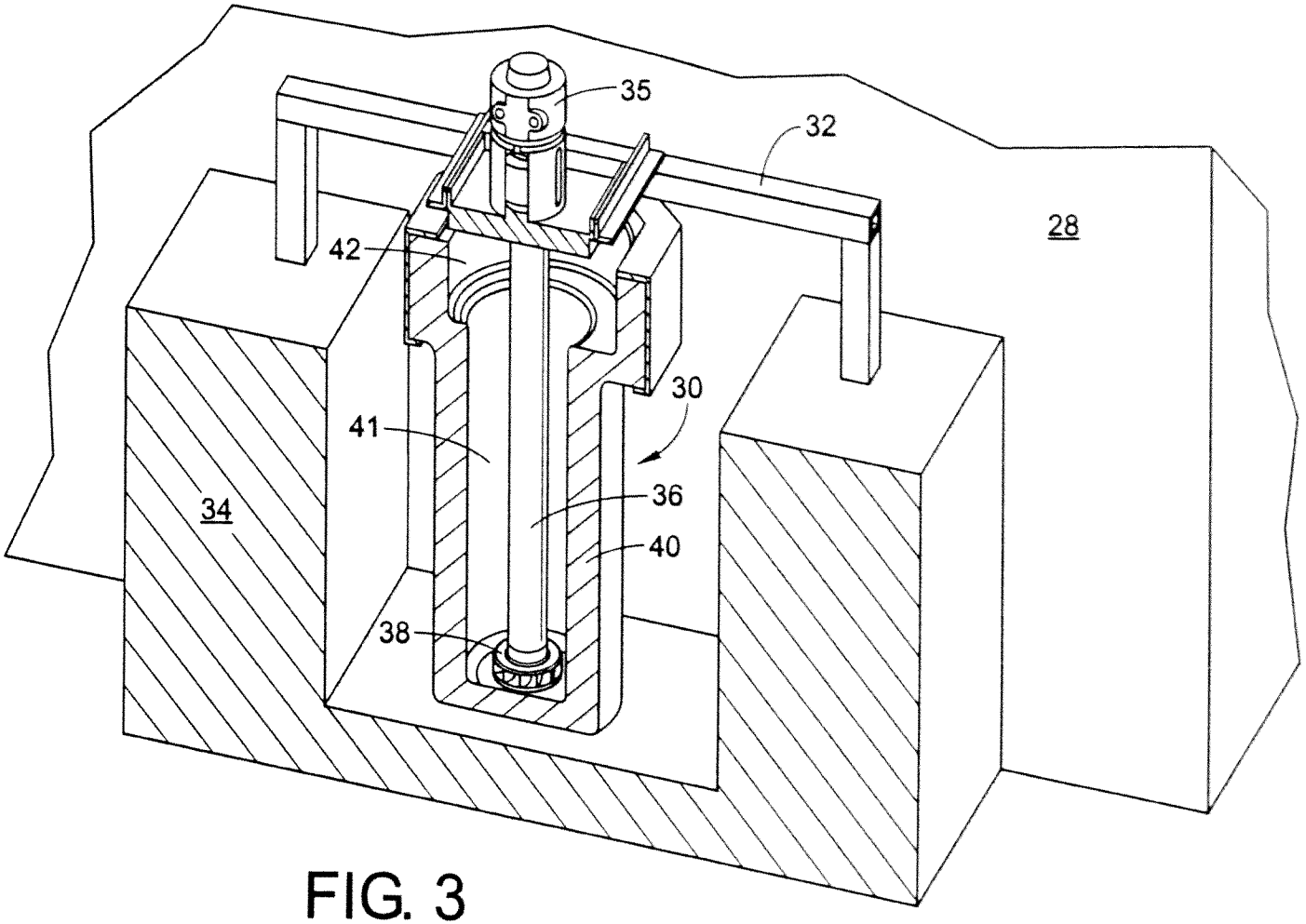
FIG. 3 is a perspective partially in cross-section view of the system of FIG. 2.
Figure 4:
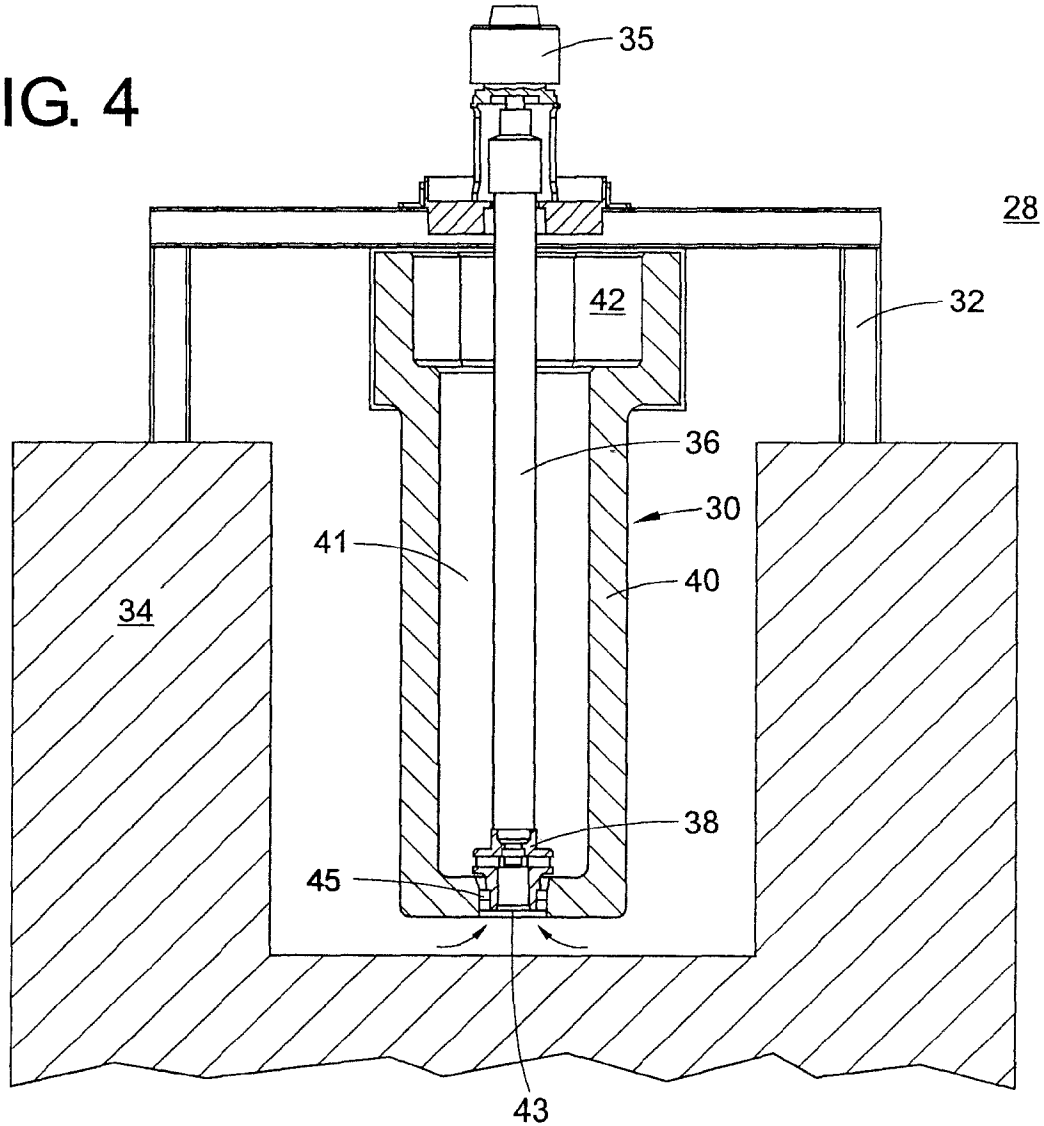
FIG. 4 is a side cross-sectional view of the system shown in FIGS. 2 and 3.

With reference to FIGS. 2-4, the molten metal pump 30 of the present invention is depicted in association with a furnace 28. Pump 30 is suspended via metallic framing 32 which rests on the walls of the furnace bay 34. A motor 35 rotates a shaft 36 and the appended impeller 38. A refractory body 40 forms an elongated generally cylindrical pump chamber or tube 41. The refractory body can be formed, for example, from fused silica, silicon carbide or combinations thereof. Body 40 includes an inlet 43 which receives impeller 38. Preferably, bearing rings 45 are provided to facilitate even wear and rotation of the impeller 38 therein. In operation, molten metal is drawn into the impeller through the inlet (arrows) and forced upwardly within tube 41 in the shape of a forced ("equilibrium") vortex. At a top of the tube 41 a volute shaped chamber 42 is provided to direct the molten metal vortex created by rotation of the impeller outwardly into trough 44. Trough 44 can be joined/mated with additional trough members or tubing to direct the molten metal to its desired location such as a casting apparatus, a ladle or other mechanism as known to those skilled in the art.

Although depicted as a volute cavity, an alternative mechanism could be utilized to divert the rotating molten metal vortex into the trough. In fact, a tangential outlet extending from even a cylindrical cavity will achieve molten metal flow. However, a diverter such as a wing extending into the flow pattern or other element which directs the molten metal into the trough may be preferred.

In addition, in certain environments, it may be desirable to form the base of the tube into a general bell shape, rather than flat. This design may produce a deeper vortex and allow the device to have improved function as a scrap submergence unit.

Figure 5:
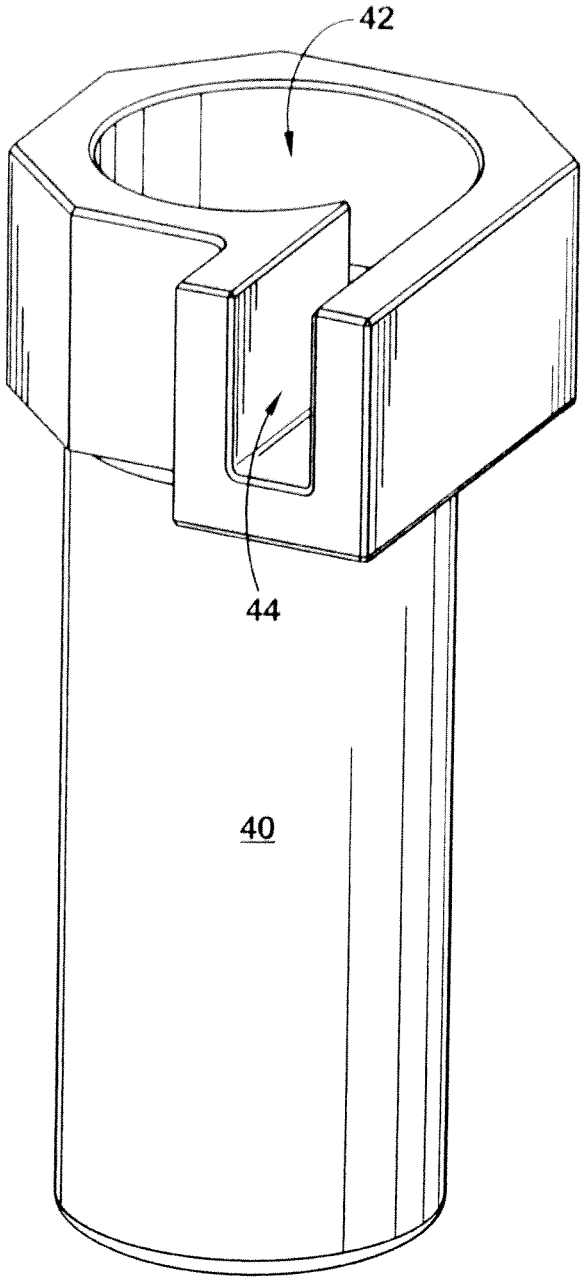
FIG. 5 is a perspective view of the pumping chamber.
Figure 7:
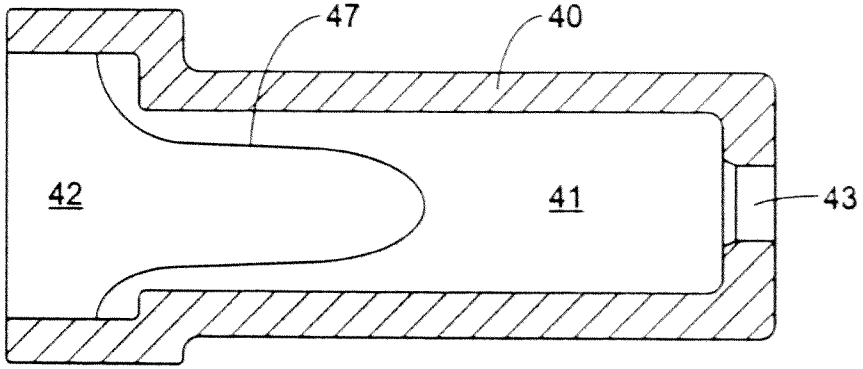
FIG. 7 is a view along the line A-A of FIG. 6.
Figure 6:
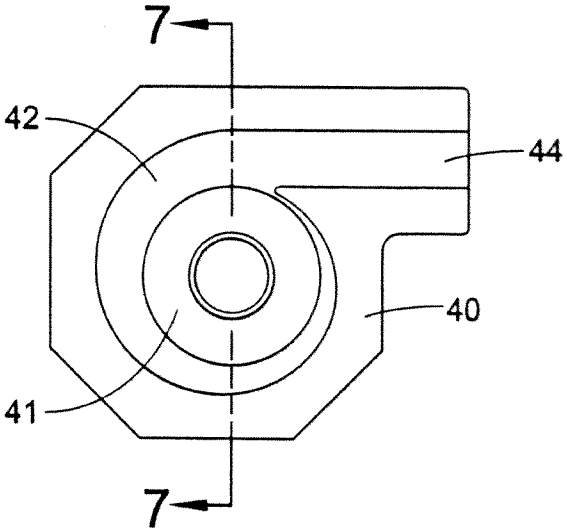
FIG. 6 is a top view of the pumping chamber.

Turning now to FIGS. 5-7, the tube 41 is shown in greater detail. FIG. 5 shows a perspective view of the refractory body. FIG. 6 shows a top view of the volute design and FIG. 7 a cross-sectional view of the elongated generally cylindrical pumping chamber. These views show the general design parameters where the tube 41 is at least 1.1 times greater in diameter, preferably at least about 1.5 times, and most preferably, at least about 2.0 times greater than the impeller diameter. However, for higher density metals, such as zinc, it may be desirable that the impeller diameter relative to pumping chamber diameter be at the lower range of 1.1 to 1.3. In addition, it can be seen that the tube 41 is significantly greater in length than the impeller is in height. Preferably, the tube length (height) is at least three times, more preferably at least 10 times, greater than a height of the impeller. Without being bound by theory, it is believed that these dimensions facilitate formation of a desirable forced ("equilibrium") vortex of molten metal as shown by line 47 in FIG. 7.

Figure 8:
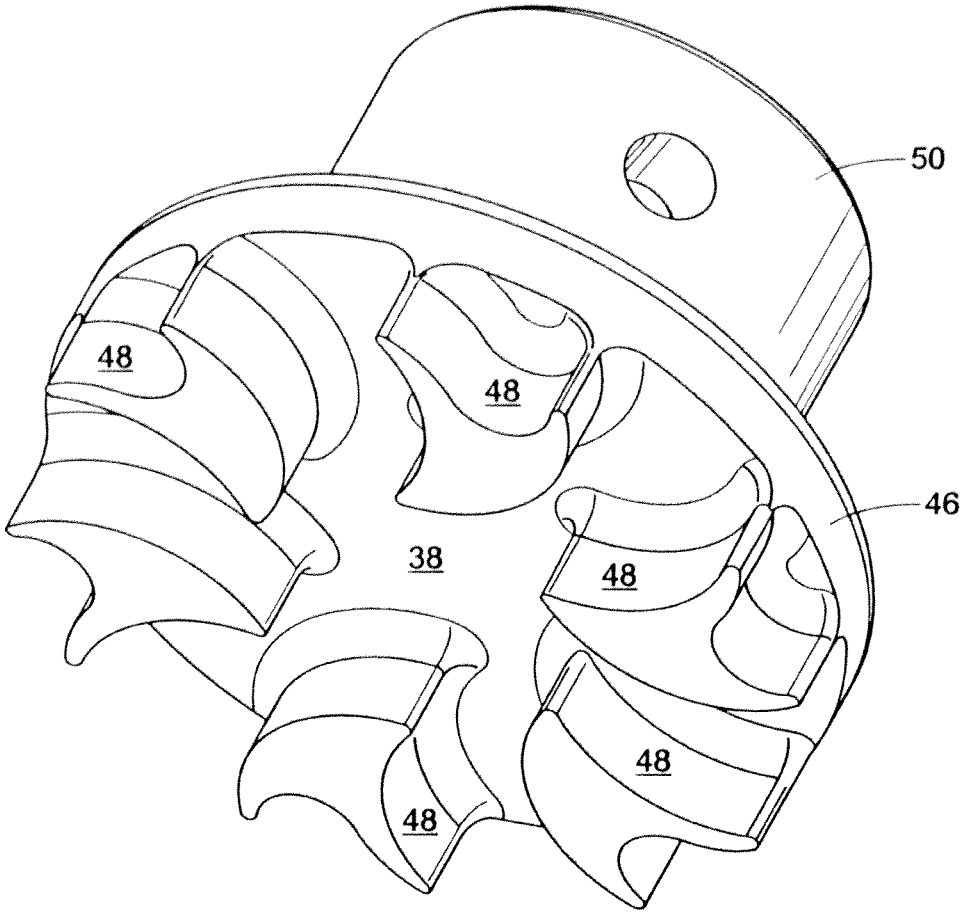
FIG. 8 is a perspective view of the impeller top section.
Figure 9:
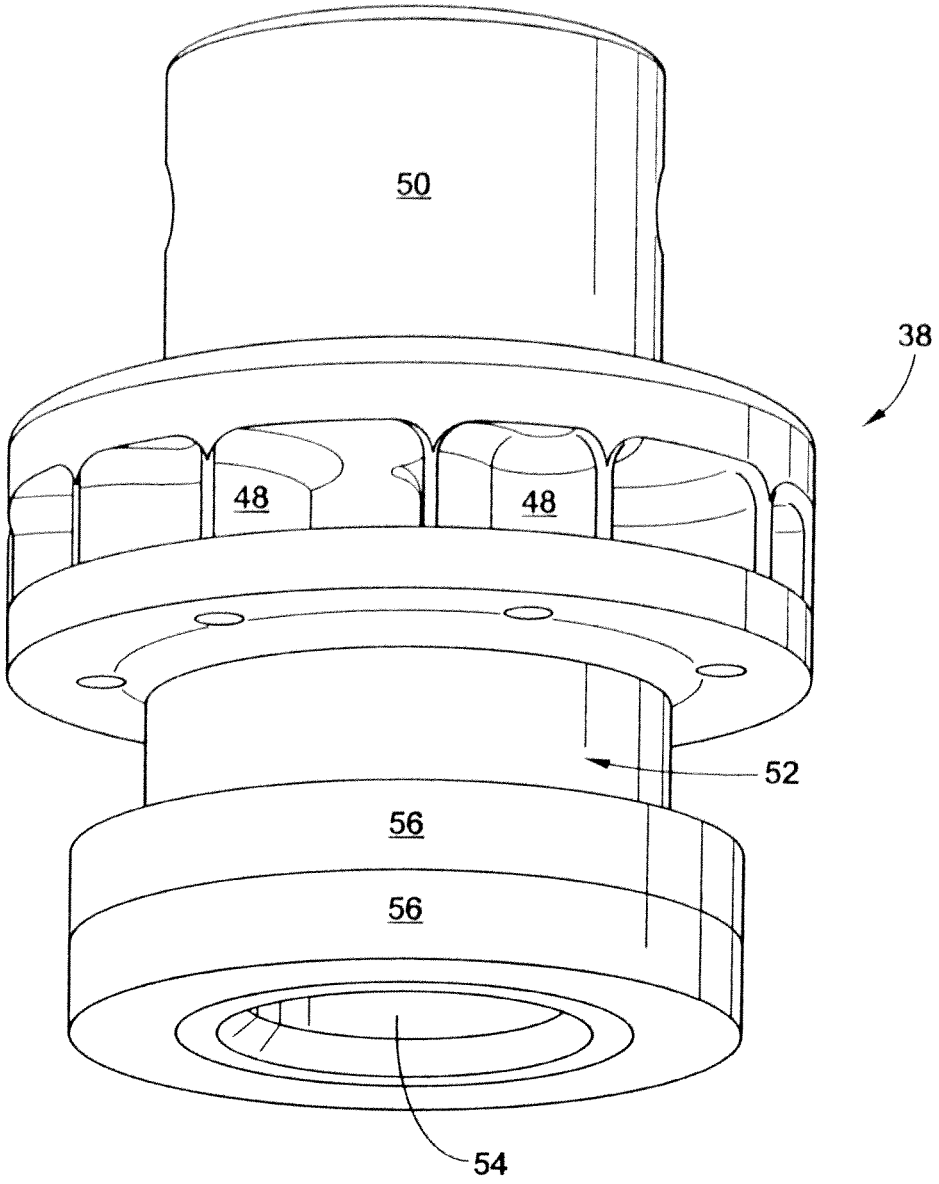
FIG. 9 is a perspective view of the assembled impeller.

FIGS. 8 and 9 depict the impeller 38 which includes top section 46 having vanes 48 supplying the induced molten metal flow and a hub 50 for mating with the shaft 36. In its assembled condition, impeller 38 is mated via screws or bolts to an inlet guide section 52 having a hollow central portion 54 and bearing rings 56. The impeller can be constructed of graphite or other suitable refractory material. It is envisioned that any traditional molten metal impeller design would be functional in the present overflow vortex transfer system.

Figure 10:
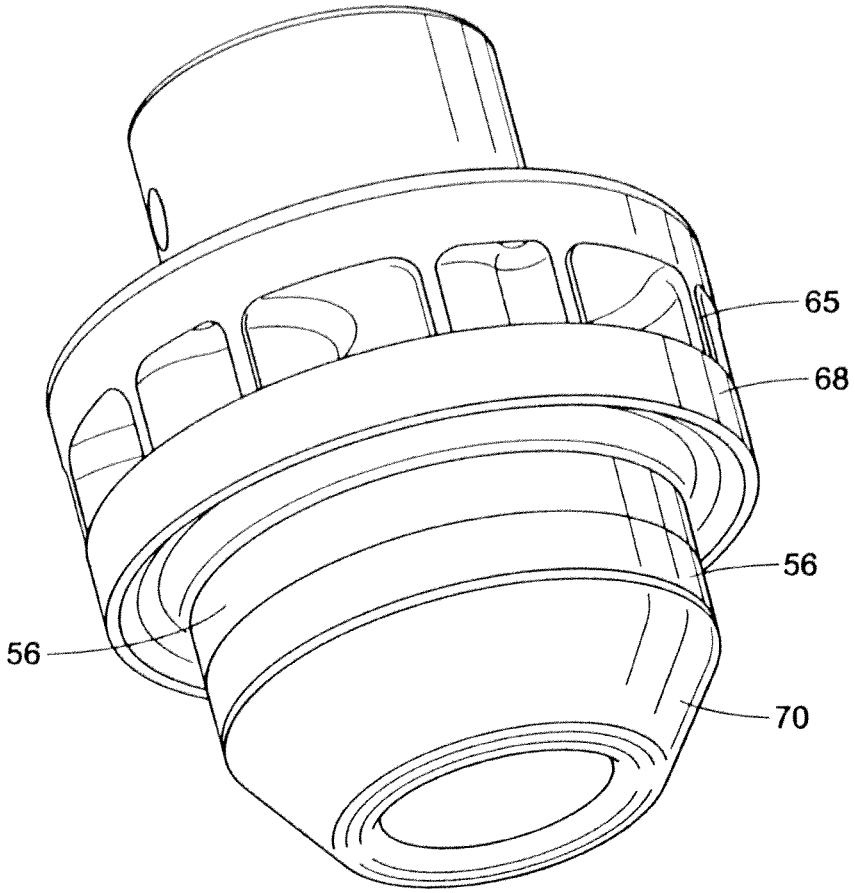
FIG. 10 is an alternative impeller design.
Figure 11:
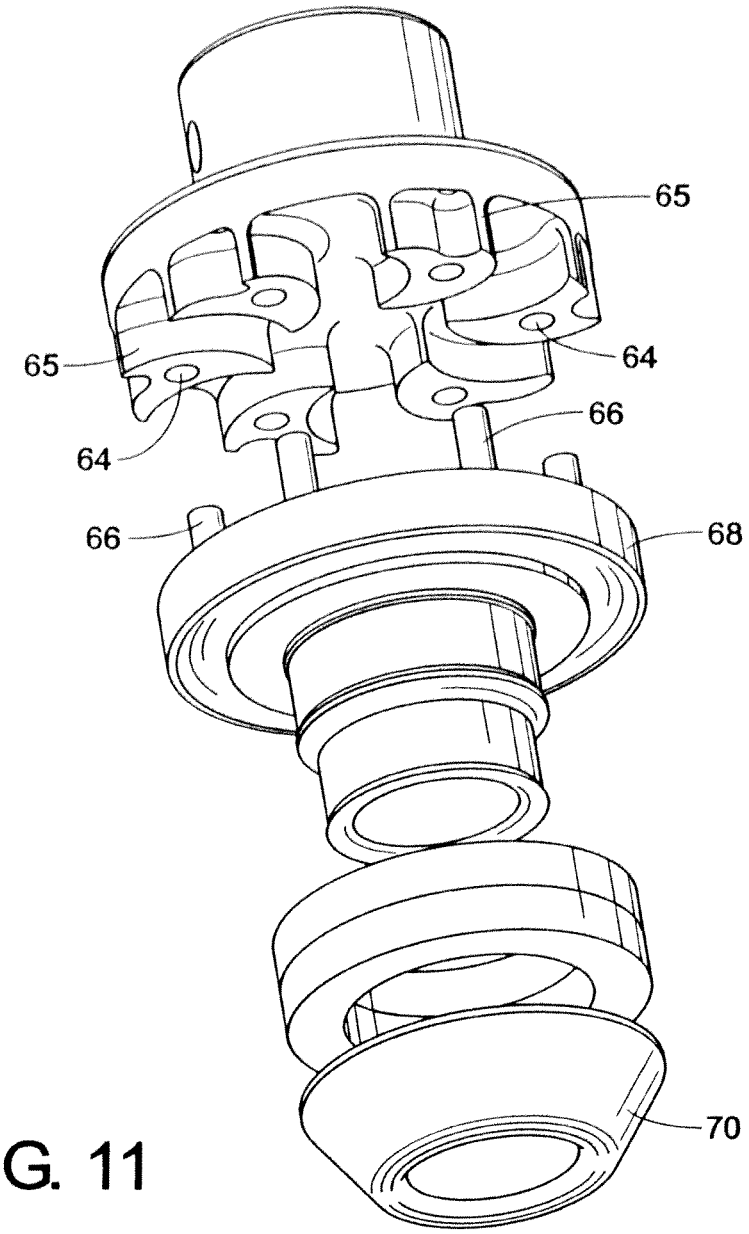
FIG. 11 is an exploded view of the impeller of FIG. 10.

Referring now to FIGS. 10 and 11, an alternative impeller design is depicted. In this embodiment, the impeller top section 62 includes bores 64 in the vanes 65 which receive posts 66 to facilitate proper registration of the components and increase the mating strength. In addition, the inlet guide section 68 has been extended relative to the prior design to include bearing rings 56 and added alignment element 70. Particularly, alignment element 70 is received within a the cooperatively shaped inlet 43.

Figure 12:
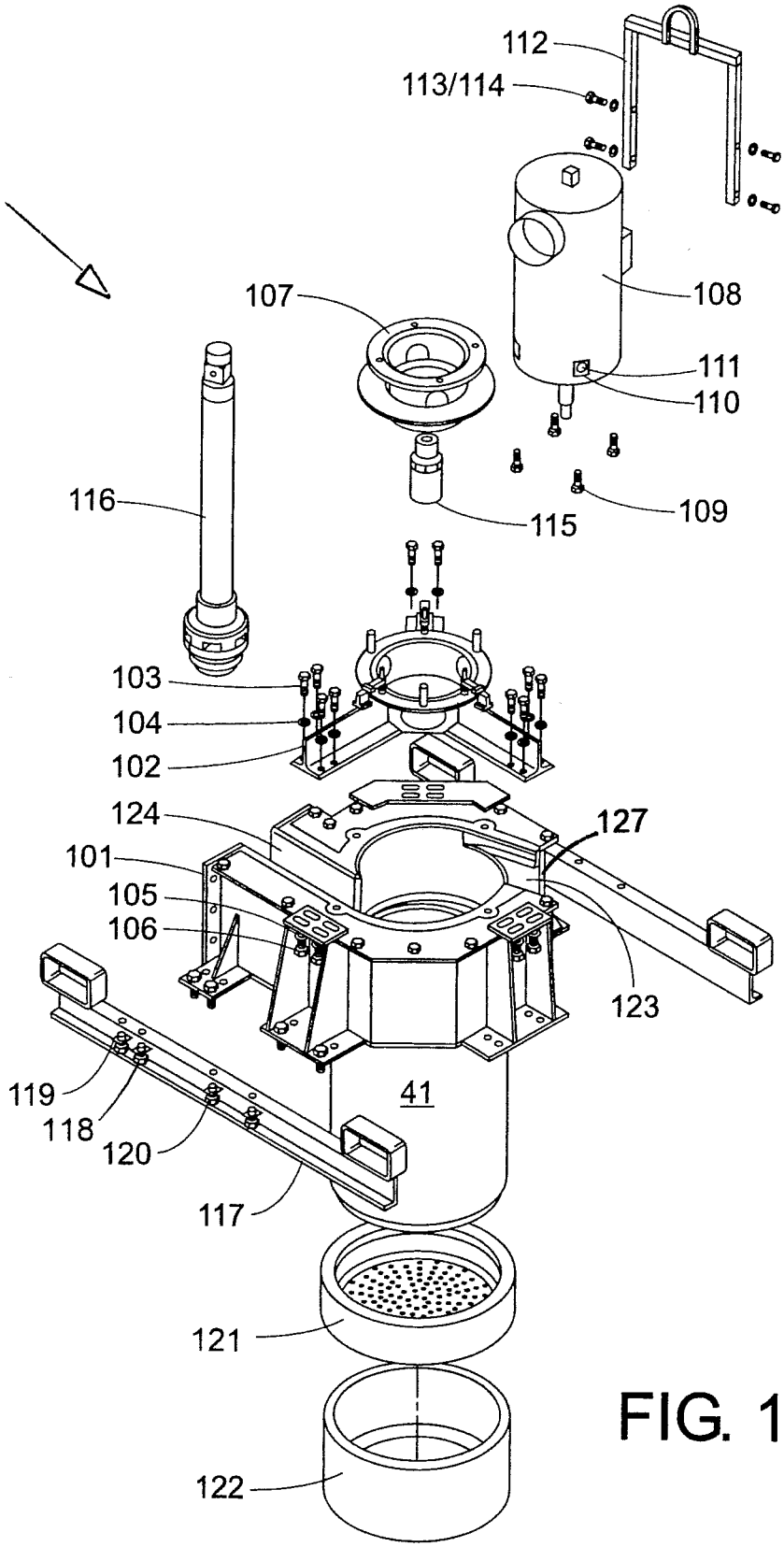
FIG. 12 is an alternative embodiment with an electric motor.

Referring now to FIG. 12, the pump assembly 100 has a metal frame 101 surrounding the top portion (outlet chamber) of the refractory tube 41, and includes a motor mount 102 which is secured to the pump assembly 100. The motor mount assembly 102 is secured to together via hex bolts 103, flat washers 104, lock washers 105 and hex nut 106. Motor adaptor assembly 107 joins electric motor 108 to the motor mount 102. Particularly, hex bolts 109, lock washers 110, hex nuts 111 provide the mating between electric motor adaptor assembly 107 and electric motor 108. A hanger 112 is provided to facilitate the lifting of the assembly. Hanger 112 is secured to the motor via hex bolts 113 and flat washers 114. Heat break coupling assembly 115 mates the motor drive shaft to the shaft and impeller assembly 116. A mounting support assembly 117 including hex bolts 118, bevel washer 119 and hex nut 120 is provided to secure the assembly to the furnace. A strainer 123 and a filter cap 122 are provided to protect against ingress of unwanted debris into the pump. In this embodiment, a compressible fiber blank 127 can be disposed between the steel frame and the refractory bowl to accommodate variations in thermal expansion rates. Furthermore, in this embodiment the outlet chamber is provided with an overflow notch 123 to safely return molten metal to the furnace in the event of a downstream obstruction which blocks primary outlet trough 124. Overflow notch 123 has a shallower depth than primary outlet trough 124.

Figure 13:
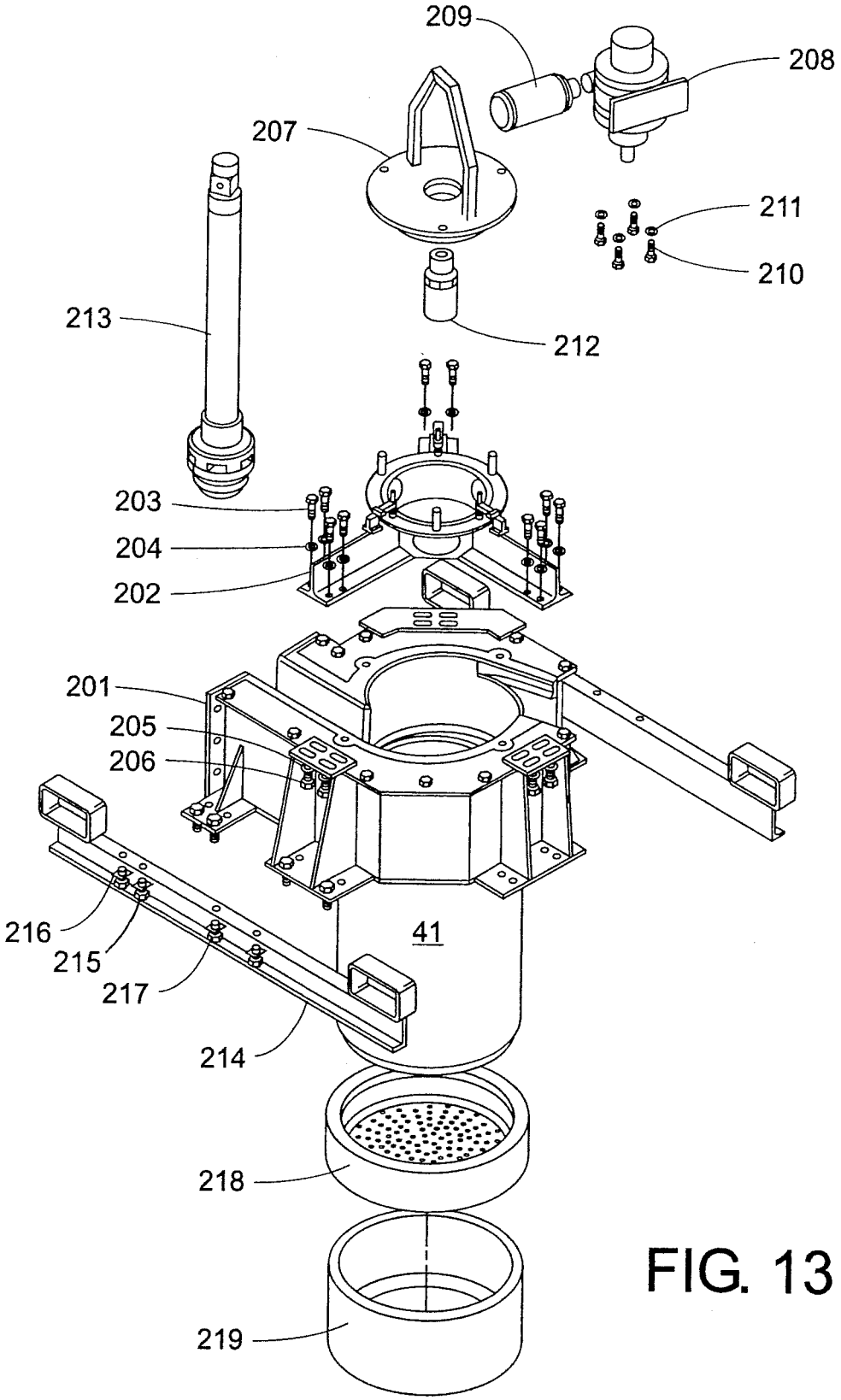
FIG. 13 is a further alternative embodiment with an air motor.

Referring now to FIG. 13, an overflow pump with an air motor option is depicted. Particularly, a metal frame 201 surrounds tube 41 and is mated to a motor mount assembly 202 via hex bolts 203, flat washers 204, lock washers 205 and hex nuts 206. Motor adapter assembly 207 facilitates mounting of the air motor 208 thereto. Air motor 208 includes a muffler 209 and is secured to the air motor adapter assembly 207 via hex bolts 210, and lock washers 211. A heat break coupling 212 mates the drive shaft of the air motor 208 to shaft and impeller assembly 213. Mounting support assembly 214 is provided to secure the unit to the refractory furnace. Particularly, hex bolts 215, bevel washers 216 and hex nuts 217 provide securement thereof. In addition, strainer 218 and filter cap 219 are provided.

The invention has many advantages in that its design creates an equilibrium vortex at a low impeller RPM, creating a smooth surface with lithe to no air intake. Accordingly, the vortex is non-violent and creates little or no dross. Moreover, the present pump creates a forced vortex having a constant angular velocity such that the column of rotating molten metal rotates as a solid body having very little turbulence.

Other advantages include the elimination of the riser component in traditional molten metal pumps which can be fragile and prone to clogging and damage. In addition, the design provides a very small footprint relative to the traditional transfer pump base and has the ability to locate the impeller very close to the bay bottom, allowing for very low metal draw down. As a result of the small footprint. The device is suitable for current refractory furnace designs and will not require significant modification thereto.

The pump has excellent flow tunability, its open design structure provides for simple and easily cleaning access. Advantageously, only shaft and impeller replacement parts will generally be required. In fact is generally self-cleaning wherein dross formation in the riser is eliminated because the metal level is high. Generally, a lower torque motor, such as an air motor, will be sufficient because of the low torque experienced.

Optional additions to the design include the location of a filter at the base of the inlet of the pumping chamber. It is further envisioned that the pump would be suitable for use in molten zinc environments where a very long, pull (e.g. 14 ft.) is required. Such a design may preferably include the addition of a bearing mechanism at a location on the rotating shaft intermediate the motor and impeller. Furthermore, in a zinc application, the entire construction could be manufactured from metal, such as steel or stainless steel, including the pumping chamber tube, and optionally the shaft and impeller.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molten metal pump comprising an elongated tube having a base end, a top end and a longitudinal axis, said tube defining a pumping chamber, a shaft disposed within said tube and a centrifugal impeller rotatable by said shaft, said impeller including a bearing ring portion, said impeller disposed in said pumping chamber proximate said base end, the bearing ring portion of said impeller forming a bearing surface with said tube, said pumping chamber adjacent said impeller having a diameter at least 1.1 times a diameter of the impeller, said base end including an inlet and said top end including an outlet, a distance between said inlet and said outlet being at least three times a height of said impeller and less than 14 feet, and wherein said top end includes a chamber directing a flow of molten metal radially to said outlet.

2. The molten metal pump of claim 1 wherein said tube has a diameter of at least 1.5 times the diameter of the impeller.

3. The molten metal pump of claim 1 wherein said distance is at least ten times the height of the impeller.

4. The molten metal pump of claim 1 wherein said tube is comprised of a refractory ceramic.

5. The molten metal pump of claim 1 wherein said chamber includes a volute shape.

6. The molten metal pump of claim 1 wherein said outlet is tangential to a sidewall forming said chamber.

7. The molten metal pump of claim 1 wherein a metal frame surrounds at least a portion of said chamber.

8. The molten metal pump of claim 7 wherein a compressible material is disposed between said metal frame and said chamber.

9. The molten metal pump of claim 1, wherein said chamber further includes a safety spillway.

10. The molten metal pump of claim 9 wherein said outlet comprises a channel in a side wall of said chamber, said channel having a depth substantially equal to a depth of said chamber.

11. The molten metal pump of claim 10 wherein said safety spillway comprises a channel having a depth less than a depth of said outlet channel.

12. The molten metal pump of claim 1 wherein said impeller includes a chamfered registration region shaped cooperatively to said inlet.

13. The molten metal pump of claim 1 wherein, in operation, molten metal is drawn into the impeller through the inlet and forced upwardly within the tube in the shape of a forced vortex.

14. The molten metal pump of claim 1 wherein said chamber has a diameter greater than the diameter of the tube intermediate said inlet and said outlet.

15. The molten metal pump of claim 1 wherein said bearing ring portion is disposed in said inlet.

16. A molten metal pump comprised of an elongated refractory body, said refractory body having an inlet region having an inlet diameter, a vortex region having a vortex region diameter, and an outlet region having an outlet region diameter, wherein said outlet region diameter is greater than said vortex region diameter, and said vortex region diameter is greater than said inlet region diameter, an impeller having at least a bearing ring portion disposed in said inlet and forming a bearing surface therewith, said impeller relative to the refractory body having a bottom inlet and side outlets, a shaft comprised of a refractory material extending through said vortex region and said outlet region and including a first end engaging the impeller and a second end adapted to engage a motor via a coupling.

17. The molten metal pump of claim 16 including an outlet channel intersecting said outlet region.

18. The molten metal pump of claim 16 wherein said vortex region has a height greater than a height of said inlet region and said outlet region.

19. The molten metal pump of claim 17 where said outlet region comprises a volute shape.

20. The molten metal pump of claim 16 wherein said side outlets are defined by a plurality of vanes.

* * * * *